US005655334A

United States Patent [19]

Kwiatkowski

[11] Patent Number: 5,655,334

[45] Date of Patent: Aug. 12, 1997

[54] SNOW STOP WITH CONVOLUTE HOOK

[75] Inventor: Janusz Kwiatkowski, Revere, Mass.

[73] Assignee: M. J. Mullane Company, Inc., Hudson, Mass.

[21] Appl. No.: 721,215

[22] Filed: Sep. 26, 1996

[51] Int. Cl.[6] ..... E04D 13/00

[52] U.S. Cl. ..... 52/24; 52/26

[58] Field of Search ..... 52/24–26

[56] References Cited

U.S. PATENT DOCUMENTS

| | | | |
|---|---|---|---|
| D. 30,788 | 5/1899 | Clark | D8/499 |
| 625,144 | 5/1899 | Clark | 52/24 |
| 654,438 | 7/1900 | Clark | 52/24 |
| 1,222,953 | 4/1917 | Histand | 52/24 |
| 1,475,931 | 12/1923 | Campbell | 52/24 |
| 1,530,233 | 3/1925 | Campbell | 52/24 |
| 1,647,345 | 11/1927 | Douglas | 52/24 |
| 3,296,750 | 1/1967 | Zaleski | 52/24 |
| 3,583,133 | 6/1971 | Winski | 52/173 |
| 5,371,979 | 12/1994 | Kwiatkowski et al. | 52/24 |
| 5,570,557 | 11/1996 | Kwiatkowski et al. | 52/630 |

FOREIGN PATENT DOCUMENTS

| | | | |
|---|---|---|---|
| 255102 | 6/1967 | Austria | 52/24 |
| 1215468 | 4/1960 | France | 52/24 |
| 4009164 | 9/1991 | Germany | 52/24 |

OTHER PUBLICATIONS

M. J. Mullane Company, "Cast Snow & Ice Guards," Jun. 1994.

M. J. Mullane Company, "Model #100S: For Retrofit or New Installation on Slate, Shake and Shingle Roofs," 1996.

*Primary Examiner*—Lanna Mai

*Attorney, Agent, or Firm*—Christopher John Rudy

[57] ABSTRACT

Snow stop has a base, a snow-hindering member, and a convolute hook. The convolute hook includes a forward section, a first opening section, and a further opening section; the convolute hook can be present at a distal end of a base of the snow stop, and it also can include a distal base bend section, and an extending section. The snow stop can have its base and convolute hook made to include sheet metal, for an example, copper. In general, the convolute hook can act as a spring. The hook minimizes or eliminates crushing of the same, and the snow stop can be retro-fit in slate, shake and shingle roofs efficiently.

7 Claims, 1 Drawing Sheet

SNOW STOP WITH CONVOLUTE HOOK

GENERAL FIELD OF THE INVENTION

This invention concerns a snow stop and roofing therewith.

BACKGROUND TO THE INVENTION

Various snow stops are known. See, e.g., Kwiatkowski et al., U.S. Pat. No. 5,371,979 (Dec. 13, 1994); U.S. patent application Ser. No. 08/417,104 filed Apr. 5, 1995, now U.S. Pat. No. 5,570,557 (Nov. 5, 1996); and M.J. Mullane Company, "Cast Snow & Ice Guards," June 1994. As good as such snow stops are, in the retro-fit of such roofs as those made of an overlapping material as, for example, of slate, they are not without problem.

In particular, known, hooked-end snow stops made of sheet metal may have their hook crushed when retro-fitting to installed slate roofs is done. Accordingly, out of a quantity of such snow stops, a number become damaged at their hook end in installation, and the installation of the same can be difficult.

It would be desirable to overcome such a problem.

SUMMARY OF THE INVENTION

The present invention provides a snow stop with a convolute hook. It is useful in roofing and stopping snow thereby, and, in particular, in retro-fitting of slate, shake and shingle roofs.

Significantly by the invention, problems in the art are ameliorated if not overcome. In particular, the snow stop with convolute hook can be retro-fit in slate, shake and shingle roofs with minimization if not elimination of crushing of the hook, and thus, snow stops are saved, and installation is more efficient.

Numerous further advantages attend the invention.

DRAWINGS IN BRIEF

The drawings form part of the specification hereof. In the drawings, the following is briefly noted:

ILLUSTRATIVE DETAIL

Figure 1:
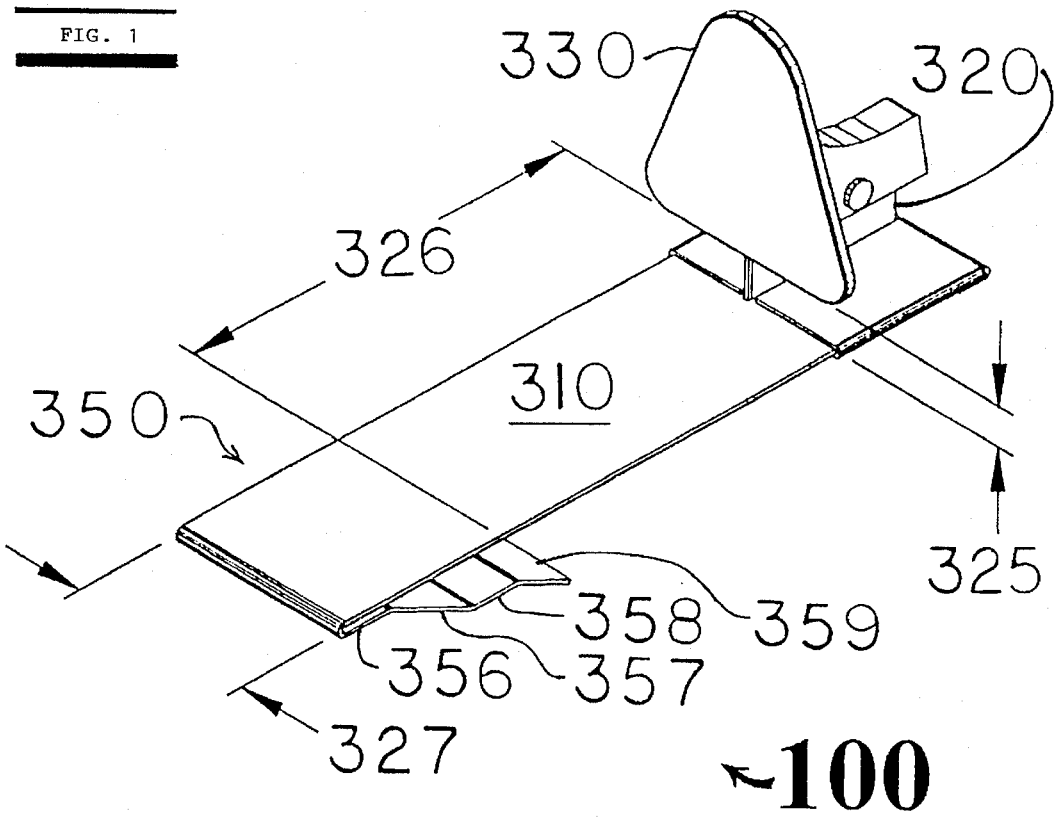
FIG. 1 is a perspective view of a snow stop with convolute hook of the present invention.

The invention can be further understood by the following detail, especially when taken in conjunction with the drawings. The same is to be taken in an illustrative, and not necessarily limiting, sense.

Both aforementioned patent documents to Kwiatkowski et al., U.S. Pat. No. 5,371,979 & Ser. No. 08/417104, are incorporated herein by reference.

In reference to the drawings, snow stop of the invention 100 generally includes base 310 and snow-hindering member, which is frequently formed to include support 320 projecting from the base, and restraining member 330 attached to or made integral with and part of the support. It includes convolute hook 350.

Figure 2:
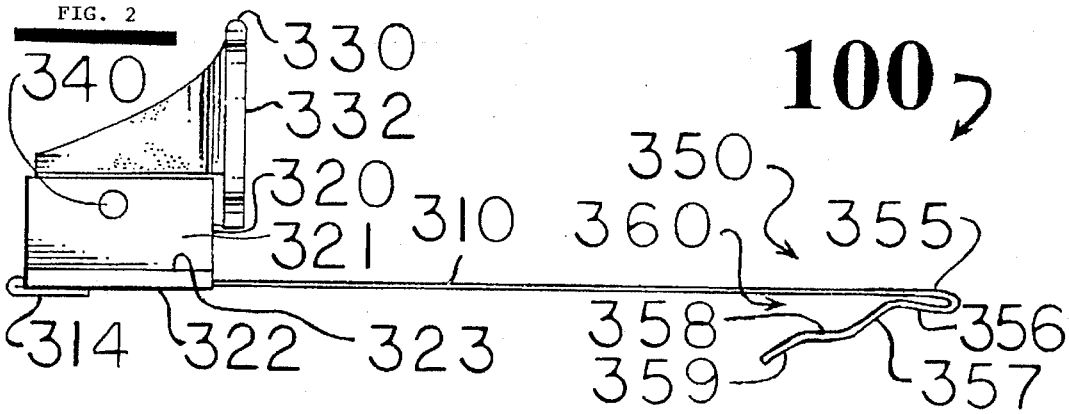
FIG. 2 is a side view of a snow stop such as of FIG. 1.

The snow stop may be of any suitable shape. However, the snow stop 100 is advantageously inclusive of materials/features of its snow-hindering member such as disclosed by Kwiatkowski et al., U.S. Pat. No. 5,371,979. As such, and analogous thereto, it can include the base 310 to include tail 314; the support 320 to include leg 321, foot 322 and toe 323; the restraining member 330 to include face 332; and attaching rivet 340. Advantageously, as depicted in FIGS. 1 & 2, the convolute hook 350 is about an end of the snow stop which is distal to the snow-hindering member 320/330. The snow stop hereof may incorporate features from another snow stop or so-called snow guard. Accordingly, the snow stop hereof may incorporate features from Kwiatkowski et al., Ser. No. 08/417104.

In general, the convolute hook 350 can act as a spring. It may have a distal base bend section, and it has forward and opening sections, optionally having an extending section, and it has a further opening section. The same may be defined, in general, by features 355, 356, 357, 358 and 359, respectively.

Thus, in the convolute hook 350, between a top feature set, i.e., the base 310 as may include therein the optional base bend section 355, and a bottom feature set, i.e., the forward and the opening sections 356 and 357, as may exist with the optional extending section 358, but including the further opening section 359, is bounded space 360. The space 360 opens rearwardly, in the same direction as that in which snow would flow so as to be restrained by the snow-hindering member 320/330 if the snow stop 100 were suitably installed.

Parts/features appear and are connectable appropriately.

The snow stop may be made of any suitable materials and have any suitable dimensions. The base and convolute hook can be made to include sheet metal. For example, the snow stop 100 can be made to include 24-ounce cold-rolled copper (7.3 kg/m) for the base 310, support 320, and convolute hook 350, with a cast bronze alloy restraining member 330 held to the support by a copper rivet 340. For example # C90500 lead-coated copper is another advantageous material to employ. A typical snow stop 100 may include dimensions (FIG. 1) as follows:

325: Sized according to thickness of the roofing material, for an example, ⅜ inch (9.6 mm).

326: 3¾ inch (100 mm).

327: 1¾ inch (45 mm).

Further, the convolute hook 350 may include features having such dimensions (FIGS. 1 & 2) as follows:

355: 7/16 inch (11 mm) angled 175 degrees to the base.

356: 7/16 inch (11 mm) angled 170 degrees to the base.

357: ⅜ inch (9.5 mm) angled 35 degrees to the base.

358: ⅜ inch (9.5 mm) angled 10 degrees to the base.

359: ¼ inch (6.3 mm) angled 30 degrees to the base.

Such dimensions may be considered to be approximate. Nonetheless, the angles assist in providing the spring action to the convolute hook, and, as a consequence, a certain care should be taken in the manufacture of the same.

The snow stop hereof can be made by known methods. These may include cutting, bending, folding, casting, screwing, riveting, pressing and so forth.

The snow stop hereof can be installed by known methods.

The snow stop of the invention is well received.

CONCLUSION

The present invention is thus provided. Numerous modifications can be effected within its spirit, the literal claim scope of which is particularly pointed out as follows:

I claim:

1. A snow stop comprising a base and a snow-hindering member, and a convolute hook, wherein the snow-hindering member is attached to and generally extends above the base; wherein the convolute hook is attached to and generally extends below the base, and includes a forward section extending from and under and connectable to the base, a first opening section extending from and connectable to the forward section, and a further opening section extending from and connectable to the first opening section, and wherein, by a top feature set, which includes the base, and a bottom feature set, which includes the forward, the first opening, and the further opening sections, is defined a space between said top and bottom feature sets, said space opening rearwardly, in the same direction as that in which snow would flow so as to be restrained by the snow-hindering member if the snow stop were suitably installed.

2. A snow stop comprising a base and a snow-hindering member, and a convolute hook, wherein the snow-hindering member is attached to and generally extends above the base; wherein the convolute hook is attached to and generally extends below the base, and includes a forward section extending from and being under, and connectable to the base, a first opening section extending from and connectable to the forward section, and a further opening section extending from and connectable to the first opening section; wherein, by a top feature set, which includes the base, and a bottom feature set, which includes the forward, the first opening, and the further opening sections, is bounded defined a space between said top and bottom feature sets, said space opening rearwardly and in the same direction as that in which snow would flow so as to be restrained by the snow-hindering member if the snow stop were suitably installed, and wherein, in general, the convolute hook acts as a spring.

3. The snow stop of claim 2, wherein the convolute hook is present at a distal end of the base and the base also includes a distal base bend section which bends the base downward thereat, and an extending section between and connectable to the first and further opening sections, and wherein said space is bounded on top by the distal base bend section and on bottom by the extending section.

4. The snow stop of claim 3, wherein the base and convolute hook are made to include sheet metal.

5. The snow stop of claim 4, wherein the sheet metal is copper.

6. The snow stop of claim 4, wherein the sheet metal is lead-coated copper.

7. A snow stop comprising a base and a snow-hindering member, and a convolute hook, including a distal base end section, angled at about 175 degrees to the base; a forward section, connected to the distal base end section and angled at about 170 degrees to the base; a first opening section, connected to the forward section and angled at about 35 degrees to the base; an extending section, connected to the first opening section and angled at about 10 degrees to the base; and a further opening section, connected to the extending section and angled at about 30 degrees to the base, wherein, between a top feature set, which includes the base and the distal base end section, and a bottom feature set, which includes the forward, the first opening, the extending and the further opening sections, is bounded a space, said space opening rearwardly and in the same direction as that in which snow would flow so as to be restrained by the snow-hindering member if the snow stop were suitably installed, and wherein the base and convolute hook are made to include sheet metal.

* * * * *